US005248386A

United States Patent [19]

Dastolfo, Jr. et al.

[11] Patent Number: 5,248,386

[45] Date of Patent: Sep. 28, 1993

[54] MILLING SOLUTION AND METHOD

[75] Inventors: LeRoy E. Dastolfo, Jr., Lower Burrell; Gary P. Tarcy, Plum Boro, both of Pa.; William P. Wehrle, Copley; Mark E. Davis, Sheffield Lake, both of Ohio

[73] Assignee: Aluminum Company of America, Pittsburgh, Pa.

[21] Appl. No.: 848,886

[22] Filed: Mar. 10, 1992

Related U.S. Application Data

[63] Continuation-in-part of Ser. No. 807,725, Dec. 16, 1991, which is a continuation-in-part of Ser. No. 652,587, Feb. 8, 1991, Pat. No. 5,100,500.

[51] Int. Cl.[5] ..... B44C 1/22; C23F 1/00; C09K 13/08

[52] U.S. Cl. ..... 156/659.1; 156/654; 156/664; 252/79.2; 252/79.3

[58] Field of Search ..... 156/637, 639, 654, 656, 156/659.1, 664; 134/2, 3, 39, 40, 41; 252/79.1, 79.2, 79.3, 79.4, 142

[56] References Cited

U.S. PATENT DOCUMENTS

| | | | |
|---|---|---|---|
| 2,739,047 | 3/1956 | Sanz | 41/43 |
| 2,974,021 | 3/1961 | Borowik | 252/79.3 X |
| 2,981,610 | 4/1961 | Snyder et al. | 42/42 |
| 3,666,580 | 5/1972 | Kreml et al. | 156/18 |
| 3,788,914 | 1/1974 | Gumbelevicius | 156/18 |
| 3,844,859 | 10/1974 | Roni | 156/18 |
| 3,905,883 | 9/1975 | Hanazono et al. | 204/129.65 |
| 3,905,907 | 9/1975 | Shiga | 252/79.4 |
| 3,936,332 | 2/1976 | Matsumoto et al. | 156/18 |
| 3,939,089 | 2/1976 | Matsumoto et al. | 252/79.4 |
| 3,944,496 | 3/1976 | Coggins et al. | 252/79.3 |
| 3,954,498 | 5/1976 | Flowers | 134/2 |
| 4,116,755 | 9/1978 | Coggins et al. | 156/659 |
| 4,130,454 | 12/1978 | Dutkewych et al. | 156/659 |
| 4,220,706 | 9/1980 | Spak | 430/318 |
| 4,314,876 | 2/1982 | Kremer et al. | 156/664 |
| 4,337,114 | 6/1982 | Russell et al. | 156/656 |
| 4,725,374 | 2/1988 | Pryor et al. | 252/79.2 |
| 4,787,958 | 11/1988 | Lytle | 156/652 |
| 4,900,398 | 2/1990 | Chen | 156/664 |
| 4,973,380 | 11/1990 | Pryor et al. | 156/642 |
| 5,074,955 | 12/1991 | Henry et al. | 156/643 |

FOREIGN PATENT DOCUMENTS

| | | |
|---|---|---|
| 505750 | 5/1978 | U.S.S.R. . |
| 1294872 | 3/1987 | U.S.S.R. . |

*Primary Examiner*—William A. Powell
*Attorney, Agent, or Firm*—Gary P. Topolosky

[57] ABSTRACT

A substantially nitrate-free solution for milling products of refractory metals, especially titanium, which milling solution comprises: (a) about 20–100 g/l hydrofluoric acid; (b) a hydrogen inhibitor selected from the group comprising of: about 55–650 g/l of sodium chlorate, about 180–650 g/l of ammonium peroxysulfate, and at least about 10 g/l of hydrogen peroxide; and (c) a balance of water and impurities. A method for chemically milling, etching and/or pickling metal products, such as titanium alloy forgings, with the aforementioned solution is also disclosed.

29 Claims, No Drawings

MILLING SOLUTION AND METHOD

This is a continuation-in-part of U.S. application Ser. No. 07/807,725, filed on Dec. 16, 1991, which is a continuation-in-part of U.S. application Ser. No. 07/652,587, filed Feb. 8, 1991, U.S. Pat. No. 5,100,500, the disclosures both of which are fully incorporated by reference herein.

BACKGROUND OF THE INVENTION

1. Field of the Invention

This invention relates to an improved chemical milling solution and method for milling, etching or pickling metal products therewith. More particularly, the invention relates to a bath composition and method for milling or pickling titanium workpieces, such as forgings or the like.

2. Technology Review

As used herein, the term "milling" shall mean the selective and controlled removal (or corrosion) of metal (or metal oxides) from a part or object by chemical milling, etching and/or pickling. Most milling procedures form metal product of a desired thickness and/or configuration by removing metal from a treated workpiece thereby imparting greater weight savings to aerospace parts or the like. Milling operations are typically performed after a particular metal part has been formed by casting, forging, extrusion or rolling; and heat treated. Milling is also used to make shapes which cannot otherwise be machined by conventional chipmaking techniques, or which can only be machined by known methods at unreasonably high cost. For many parts, masking of certain areas is done to prevent their exposure to a corrosive milling solution.

As used for the description of this invention, "milling" shall also include metal etching, the controlled removal of metal for dimensional and shape control, and metal cleaning or pickling, i.e., the removal of embrittled oxidized surfaces. For titanium alloys, oxidized surfaces are sometimes referred to as alpha-case. Such surfaces may result from exposure to elevated temperatures during the manufacturing process, i.e., casting, rolling, extrusion, forging or the like.

Any chemically dissolvable metal may be subjected to treatment by the aforementioned milling practices. Alloys of aluminum, beryllium, magnesium, titanium and various steels are the most commonly milled metal products. Refractory metals such as molybdenum, tungsten, niobium (columbium) and zirconium may also be chemically etched in the same manner. The workpieces treated by milling (i.e. chemical, etching and/or pickling) need not be limited in size provided a large enough bath of milling solution can be maintained. Milled parts may be cast, forged, extruded or rolled. Their end shapes may be flat, tubular or in any of the complex configurations required by today's manufacturers of aerospace, automotive and other parts.

The first chemical milling practices are believed to have occurred around 2500 B.C., when ancient Egyptians used citric acid to etch copper jewelry. Current industrial milling practices can be traced back to the methods set forth in Sanz U.S. Pat. No. 2,739,047. Numerous evolutions to milling solutions have occurred since modern milling procedures were patented over 35 years ago. Many of these solution developments depended on the particular metal alloy being milled.

For titanium and titanium-based alloys, Chen U.S. Pat. No. 4,900,398 claims a milling method which uses an aqueous solution consisting essentially of 1-5% hydrofluoric acid, about 1.5-4% chlorate ion and up to about 20% of an acid selected from the group consisting of $H_2SO_4$, HCl and $HNO_3$. Although the latter acid additive is claimed as being an optional component, the only example solution from this reference requires 20 ml/l of 98% $H_2SO_4$ (or 3.6% by weight). More preferred embodiments claim about 4% sulfuric acid whereas the present milling bath is substantially sulfuric acid-free.

Many current practices for chemically milling, etching and pickling titanium workpieces employ chromic or nitric acid in a hydrofluoric acid-based bath. Hexavalent chrome is a suspect carcinogen, however, and nitric acid releases visible fumes of toxic $NO_x$ during standard milling operations. Production facilities have been under increasing regulatory pressure to reduce or eliminate such emissions from the workplace.

BRIEF DESCRIPTION OF THE INVENTION

It is a principal objective of this invention to provide a milling solution and method which eliminates the use of $Cr_2O_3$, $HNO_3$ or derivatives thereof. This invention represents a significant environmental advance over the art by using a substantially chromate and nitrate-free solution for milling titanium and other metal parts.

It is another objective to provide a milling method whose bath produces a commercially acceptable metal removal rate, preferably on the order of about 0.25 mils/side/minute or higher. It is another objective to provide means for chemically milling titanium and other refractory metals at moderate operating temperatures. It is yet another objective to provide a pickling method whose bath removes embrittled or oxidized surfaces from titanium, titanium-based alloys and other metals at commercially acceptable rates.

It is another principal objective to provide a milling formula which reduces the amount of hydrogen absorbed into the metal surface being milled. This invention decreases the amount of hydrogen absorbed thereby decreasing the impact of embrittlement and other negative effects caused by hydrogen absorption. The present method achieves reduced hydrogen absorption without resorting to such suppressor additives as chromic or nitric acid.

It is yet another objective to provide improved means for milling (i.e., chemically milling, etching and/or pickling) titanium alloys, especially alpha, alpha-beta and beta phase titanium alloys such as Ti-6Al-4V, Ti-6Al-6V-2Sn, Ti-10V-2Fe-3Al and others, which means overcome the prior art disadvantages referred to above.

In accordance with the foregoing objectives and advantages, this invention provides a substantially chromate-free and nitrate-free solution for milling metal products, especially titanium and titanium alloy workpieces. The solution comprises: (a) about 20-100 g/l of a pure hydrogen fluoride solution (or its equivalent); (b) a hydrogen inhibitor selected from the group consisting of: 55-650 g/l $NaClO_3$, 180-650 g/l $(NH_4)_2S_2O_8$ and at least about 10 g/l of $H_2O_2$; and (c) a balance of water and impurities. Preferred embodiments consist essentially of about 35-90 g/l of HF and at least one of: about 60-200 g/l sodium chlorate, about 200-450 g/l ammonium peroxysulfate and about 20-150 g/l hydrogen peroxide in solution. The latter additive reduces the amount of hydrogen absorbed by titanium workpieces during milling. There is further disclosed a method for chemically milling, etching and/or pickling metal products such as Ti-6Al-4V, Ti-6Al-6V-2Sn and Ti-10V-2Fe-3Al forgings with the aforementioned solutions.

DETAILED DESCRIPTION OF PREFERRED EMBODIMENTS

As used herein, the term "substantially chromate-free" or "substantially nitrate-free" means that the milling solution of this invention contains no chromate or nitrate ions, in any form, through positive or intentional addition. Since mixing conditions and component integrities are not always perfect, however, it is to be understood that trace amounts of chromates, nitrates or nitrate-forming compounds (i.e., less than about 1 wt. % total) may find their way into solution, even by way of contamination from the numerous metal surfaces being treated. Such inadvertent additions are covered by the term "impurities" that accompanies the water basis (or remainder) of this bath.

With respect to the claimed concentrations of hydrofluoric acid in various embodiments, it is generally known that commercial suppliers make such products available in concentrations of about 49 wt. % by way of dilution. Peroxide typically sold in concentrations of about 30–70 wt. % $H_2O_2$. It should be understood, however, that commercially available concentrations of HF and $H_2O_2$, or their equivalents, may be determined based on preferred concentrations of the pure components set forth herein.

Repeated reference is made throughout this description to the milling of a titanium-based alloy known as Ti-6Al-4V. This alloy generally contains about 6 wt. % aluminum and about 4 wt. % vanadium with a remainder of titanium. It is characterized by good corrosion resistance, elevated temperature strength, stability and good machinability. The alloy is typically sold in bar, sheet, strip, wire, extruded shape and tubing forms. It may also be produced in a variety of forging shapes. The invention is not intended to be limited to this particular alpha-beta phase titanium alloy, however. Another representative alloy containing both alpha and beta phases comprises about 6% aluminum, 2% tin, 4% zirconium, 2% molybdenum and a remainder of titanium (Ti-6Al-2Sn-4Zr-2Mo). When hardened by aging treatment, this alloy exhibits even tensile strengths comparable to that of Ti-6Al-4V. It is best suited for applications where heavy stresses are imparted for long periods of time at high temperatures. The alloy possesses good strength, toughness and stability properties at temperatures up to about 482° C. (900° F.). Another titanium-based alloy possessing particularly good welding characteristics and fabricability, with somewhat improved tensile strengths, contains about 6% aluminum, 6% vanadium and 2% tin (or Ti-6Al-6V-2Sn).

The method and composition of this invention may be used to mill other titanium-based alloys, such as commercially pure titanium metal (i.e., at least about 99.3 wt. % pure) or those containing an alpha phase only, a beta phases only such as Ti-10V-2Fe-3Al, and those containing an alpha-2 phase or gamma phase. Those titanium alloys with a beta phase, alone or in combination with an alpha phase, are generally more difficult to mill due to the beta phase's high affinity for hydrogen.

Titanium-based alloys are particularly useful for many aerospace applications, including airframe and engine parts, because of their light weight, high strength and thermal stability. Such parts are frequently machined by milling to thin cross sections and very smooth outer surface finishes.

Hydrogen absorption on the surfaces of a milled workpiece may impart undesirable internal stresses thereon. Such stresses could cause these metal parts to crack prematurely. With some metals, including titanium, sufficient quantities of $H_2$ absorption causes undesirable metal hydrides to form. In the industry, excessive hydrogen absorption is more commonly referred to as "hydrogen embrittlement". It is a principal objective of this invention to minimize the amount of hydrogen absorbed into a surface treated with the aforementioned milling solutions. For titanium alloys, the amount of hydrogen absorbed is generally proportional to the amount of beta-phase present and surface area to volume ratio of the workpiece being milled. Hydrogen contents of a milled article are typically measured in parts per million (or ppm). Most aeronautical specifications for titanium alloys permit a maximum hydrogen concentration of about 150–200 ppm, depending upon the alloy involved. Such applications are generally more conservative with respect to the amount of $H_2$ absorbed. For some non aerospace uses, higher $H_2$ concentrations of up to about 500 parts per million are tolerable.

The HF-ammonium peroxysulfate, HF-sodium chlorate and HF-hydrogen peroxide solutions of this invention have produced acceptably low levels of hydrogen pickup in many alloys such as Ti-6Al-4V while avoiding the need to add such hydrogen suppressants as chromic or nitric acid. It is believed that salts of peroxysulfate and chlorate, or hydrogen peroxide itself, provide an oxide layer on the metal surface being milled. This layer tempers the action of HF on the workpiece while providing some barrier for hydrogen diffusion into the milled metal surface. Unlike $Cr_2O_3$ or $HNO_3$, however, the aforementioned additives do not produce toxic fumes or suspect carcinogens.

The bath composition and method of this invention may be used to chemically mill, etch and/or pickle still other metals. Transition metals such as zirconium, and refractory metals such as niobium (columbium), molybdenum, tungsten and/or tantalum may be milled in a similar bath. On a preferred basis, ammonium peroxysulfate, sodium chlorate or hydrogen peroxide are separately combined with hydrogen fluoride. It is to be understood, however, that such additives may be proportionately combined in the same bath, or that still other peroxysulfates, such as $K_2S_2O_8$ or $Na_2S_2O_8$, or other chlorates, such as $KClO_3$ or $NH_4ClO_3$, may be substituted for one or more of the foregoing hydrogen inhibitors.

Depending upon the final product size and shape, it may be necessary to mask portions of the workpiece being milled by any known or subsequently developed means. One representative masking means is referred to as photoresistive masking. Another method subjects the masked areas to dipping in a neoprene-based maskant such as the version commonly supplied by Turco Company Products, Inc.

In some instances, product specimens are dipped repeatedly into one or more vats of milling solution. In other cases, the solution into which titanium alloy products are dipped may be agitated by means of an air pump, electric stirrer or continuous fluid circulation pump. Such means serve to continuously flow solution over the metal part being milled so that relatively fresh bath will contact the milling surface. In this manner, the invention achieves a substantially uniform milling or etching rate, usually on the order of about 0.15-1.5 mils/side/minute.

Before pickling titanium alloy products to remove an embrittled or oxidized surface ("alpha case") layer therefrom, it would be better to first clean such products. Cleaning of this sort may be performed chemically, by exposing the product to a salt bath, or by using any mechanical scale removal technique known to those skilled in this art. A pre-mill cleaning removes any scale, lubricants or other surface contaminants which might otherwise impede or hinder pickling according to the invention.

Preferred embodiments maintain the milling bath of this invention at a slightly elevated temperature, usually between about 16°-71° C. (60°-160° F.), and more preferably between about 21°-57° C. (70°-135° F.). It is believed that such temperatures enhance metal removal rates while not imposing undue hardships in terms of bath handling.

The following examples are provided by way of illustration. They are not intended to limit the scope of this invention in any manner. For a baseline data comparison, about 2500 ml of milling solution was prepared. The solution contained about 60 ml/l (49 wt. %) HF to which was added about 2 g/l of titanium sponge for conditioning the bath and providing a consistent starting titanium concentration thereto. The bath temperature was elevated to about 130° F. before one sample of each alloy: Ti-6Al-4V, Ti-10V-2Fe-3Al and Ti-6Al-6V-2Sn, was lowered into said bath. The starting samples weighed 8.537 g, 10.143 g and 9.495 g, respectively, and had an average thickness of 0.107 inch, 0.125 inch and 0.096 inch respectively. Each sample was then immersed with both sides exposed into a continuously stirred, solution bath.

After about 30 minutes in the milling bath described above, the three samples were simultaneously removed, rinsed with water, dried, weighed and measured. Post milling weights and thicknesses were: 7.736 g and 0.100 inch; 9.256 g and 0.119 inch; and 8.681 g and 0.091 inch, respectively. From this data, the following milling rates were calculated for these illustrative examples: 0.117 mils/minute/side for the Ti-6Al-4V specimen, 0.100 mils/min/side for the Ti-10V-2Fe-3Al specimen and at 0.083 mils/min/side for the Ti-6Al-6V-2Sn sample. Post milling hydrogen contents were then measured at 88, 69 and 96 ppm, respectively. The process was repeated several times with similarly sized specimens. Each time, the solution volume, HF amount, Ti sponge level and bath temperature were held constant while the amount of $NaClO_3$ added to the bath was varied. These results are tabulated below.

EXAMPLES 1-5

For this first set of data, the concentration of HF in each bath was kept constant at about 35 g/l and the bath temperature held at 130° F. while various amounts of $NaClO_3$ were added to determine their effect on milling and post-milling hydrogen content. All such milling rates were calculated from differences in average thickness and total exposure time for the Ti-10V-2Fe-3Al specimens so tested.

TABLE 1

| | | 35 g/l of HF | |
|---|---|---|---|
| Ex. | $NaClO_3$ g/l | Milling Rate mils/side/min | Hydrogen Content After Milling ppm |
| 1 | 0 | 0.275 | 488 |
| 2 | 40 | 0.100 | 69 |
| 3 | 80 | 0.090 | 12 |
| 4 | 120 | 0.067 | 92 |
| 5 | 160 | 0.050 | 89 |

EXAMPLES 6-10

The same bath conditions as in Table 1 were repeated, but on samples of Ti-6Al-4V metal.

TABLE 2

| Ex. | $NaClO_3$ g/l | Milling Rate mils/side/min | Hydrogen Content After Milling ppm |
|---|---|---|---|
| 6 | 0 | 0.375 | 117 |
| 7 | 40 | 0.117 | 88 |
| 8 | 80 | 0.135 | 71 |
| 9 | 120 | 0.100 | 80 |
| 10 | 160 | 0.117 | 63 |

EXAMPLES 11-15

In the next five examples, the same conditions of Tables 1 and 2 were repeated on specimens of Ti-6Al-6V-2Sn metal.

TABLE 3

| Ex. | $NaClO_3$ g/l | Milling Rate mils/side/min | Hydrogen Content After Milling ppm |
|---|---|---|---|
| 11 | 0 | 0.375 | 295 |
| 12 | 40 | 0.083 | 96 |
| 13 | 80 | 0.060 | 88 |
| 14 | 120 | 0.067 | 60 |
| 15 | 160 | 0.066 | 58 |

EXAMPLES 16-20

For the following data, 58.5 g/l of hydrofluoric acid was combined with varying amounts of $NaClO_3$ on samples of Ti-10V-2Fe-3Al at 130° F.:

TABLE 4

| | | 58.5 g/l of HF | |
|---|---|---|---|
| Ex. | $NaClO_3$ g/l | Milling Rate mils/side/min | Hydrogen Content After Milling ppm |
| 16 | 0 | 0.517 | 463 |
| 17 | 40 | 0.197 | 81 |
| 18 | 80 | 0.183 | 97 |
| 19 | 120 | 0.083 | 81 |

EXAMPLES 20-24

For these next examples, the same solution as in Table 4 was used with Ti-6Al-4V samples.

TABLE 5

| Ex. | $NaClO_3$ g/l | Milling Rate mils/side/min | Hydrogen Content After Milling ppm |
|---|---|---|---|
| 20 | 0 | 0.683 | 112 |
| 21 | 40 | 0.280 | 76 |
| 22 | 80 | 0.250 | 73 |
| 23 | 120 | 0.233 | 70 |

TABLE 5-continued

| Ex. | $NaClO_3$ g/l | Milling Rate mils/side/min | Hydrogen Content After Milling ppm |
|---|---|---|---|
| 24 | 160 | 0.450 | 147 |

EXAMPLES 25-29

For the next set of data, Ti-6Al-6V-2Sn samples were exposed to the same bath as in Tables 4 and 5.

TABLE 6

| Ex. | $NaClO_3$ g/l | Milling Rate mils/side/min | Hydrogen Content After Milling ppm |
|---|---|---|---|
| 25 | 0 | 0.750 | 257 |
| 26 | 40 | 0.181 | 141 |
| 27 | 80 | 0.050 | 64 |
| 28 | 120 | 0.033 | 65 |
| 29 | 160 | 0.050 | 106 |

EXAMPLES 30-34

In the next five examples, 82 g/l of HF was used to treat specimens of Ti-6Al-4V metal at 130° F.

TABLE 7

| | | 82 g/l of HF | |
|---|---|---|---|
| Ex. | $NaClO_3$ g/l | Milling Rate mils/side/min | Hydrogen Content After Milling ppm |
| 30 | 0 | 1.075 | 104 |
| 31 | 40 | 1.383 | 78 |
| 32 | 80 | 0.650 | 66 |
| 33 | 120 | 0.433 | 83 |
| 34 | 160 | 0.117 | 90 |

EXAMPLES 35-39

For these data points, the same bath as in Table 7 was used on samples of Ti-6Al-6V-2Sn metal.

TABLE 8

| Ex. | $NaClO_3$ g/l | Milling Rate mils/side/min | Hydrogen Content After Milling ppm |
|---|---|---|---|
| 35 | 0 | 1.250 | 188 |
| 36 | 40 | 1.733 | 550 |
| 37 | 80 | 0.433 | 145 |
| 38 | 120 | 0.133 | 76 |
| 39 | 160 | 0.017 | 72 |

EXAMPLES 40-58

For this data, milling solutions were prepared containing constant concentrations of about 48.8 g/l HF and varying amounts of $(NH_4)_2S_2O_8$. When heated to 115° F. and exposed to various samples of Ti-10V-2Fe-3Al, these solutions produced the following milling rates and hydrogen absorption levels.

TABLE 9

| | | 46.8 g/l of HF | |
|---|---|---|---|
| Ex. | $(NH4)_2S_2O_8$ g/l | Milling Rate mils/side/min | Hydrogen Content After Milling ppm |
| 40 | 0 | 0.475 | 410 |
| 41 | 10 | 0.550 | 410 |
| 42 | 20 | 0.502 | 545 |
| 43 | 30 | 0.500 | 427 |
| 44 | 40 | 0.475 | 444 |

TABLE 9-continued

| | | 46.8 g/l of HF | |
|---|---|---|---|
| Ex. | $(NH4)_2S_2O_8$ g/l | Milling Rate mils/side/min | Hydrogen Content After Milling ppm |
| 45 | 60 | 0.500 | 411 |
| 46 | 90 | 0.600 | 324 |
| 47 | 120 | 0.475 | 402 |
| 48 | 150 | 0.375 | 340 |
| 49 | 180 | 0.375 | 323 |
| 50 | 180 | 0.400 | 322 |
| 51 | 210 | 0.275 | 290 |
| 52 | 240 | 0.250 | 166 |
| 53 | 270 | 0.183 | 83 |
| 54 | 270 | 0.264 | 63 |
| 55 | 300 | 0.225 | 28 |
| 56 | 330 | 0.200 | 46 |
| 57 | 390 | 0.150 | 20 |
| 58 | 450 | 0.200 | 53 |

EXAMPLES 59-63

For the next 5 examples, Ti-6Al-6V-2Sn metal was milled in baths of 46.8 g/l HF to which was added varying concentrations of peroxide before heating to about 100° F. Such baths produced the following data:

TABLE 10

| | | 46.8 g/l of HF | |
|---|---|---|---|
| Ex. | $H_2O_2$ g/l | Milling Rate mils/side/min | Final $H_2$ ppm |
| 59 | 25 | 0.298 | 190 |
| 60 | 50 | 0.175 | 33 |
| 61 | 75 | 0.275 | 73 |
| 62 | 100 | 0.225 | 50 |
| 63 | 150 | 0.300 | 66 |

EXAMPLES 64-69

For these last 6 examples, Ti-6Al-6V-2Sn metal was milled in baths of 25 g/l HF to which was added varying concentrations of peroxide. This bath was then heated to about 80° F. before vital specimens were immersed therein. Such baths produced the following data:

TABLE 11

| | | 25 g/l of HF | |
|---|---|---|---|
| Ex. | $H_2O_2$ g/l | Milling Rate mils/side/min | Final $H_2$ ppm |
| 64 | 0 | 0.158 | 401 |
| 65 | 11.9 | 0.100 | 165 |
| 66 | 20 | 0.050 | 53 |
| 67 | 30 | 0.050 | 64 |
| 68 | 40 | 0.030 | 59 |
| 69 | 50 | 0.040 | 76 |

Having described the presently preferred embodiments, it is to be understood that the invention may be otherwise embodied within the scope of the appended claims.

What is claimed is:

1. A substantially nitrate-free solution suitable for milling a metal product at one or more temperatures between about 16°-71° C. (60°-160° F.), which comprises: (a) between about 20-100 g/l of hydrofluoric acid; (b) greater than about 50 g/l of a water-soluble chlorate; and (c) a balance of water and impurities.

2. The milling solution of claim 1 which contains about 55–650 g/l of sodium chlorate, potassium chlorate or ammonium perchlorate.

3. The milling solution of claim 1 which comprises about 35–90 g/l of hydrofluoric acid, about 60–200 g/l of sodium chlorate, and water.

4. The milling solution of claim 1 wherein the metal product consists essentially of a titanium alloy having at least one of the following: an alpha phase, beta phase and gamma phase.

5. The milling solution of claim 4 wherein the alloy is selected from the group consisting of: Ti-6Al-4V, Ti-6Al-6V-2Sn, Ti-10V-2Fe-3Al and commercially pure titanium.

6. A substantially nitrate-free solution suitable for milling a titanium product at one or more temperatures between about 16°–71° C. (60°–160° F.), said solution consisting essentially of: about 20–100 g/l of hydrofluoric acid; at least about 180 g/l of a peroxysulfate ion-containing solution; and a balance of water and impurities.

7. The solution of claim 6 wherein the bath is heated to about 21°–57° C. (70°–135° F.) for milling purposes.

8. The solution of claim 6 which contains about 200–450 g/l of ammonium peroxysulfate, potassium peroxysulfate or sodium peroxysulfate.

9. The solution of claim 6 wherein the titanium product is a Ti-6Al-4V forging.

10. The solution of claim 6 wherein titanium is removed from the product surface at a rate of about 0.15 mils/side/minute or higher.

11. The solution of claim 6 which produces a post-milling hydrogen content of about 150 ppm or less.

12. A substantially nitrate-free solution suitable for milling a metal product at one or more temperatures between about 16°–71° C. (60°–160° F.), which comprises: (a) between about 20–100 g/l of hydrofluoric acid; (b) at least about 10 g/l of a peroxide compound; and (c) a balance of water and impurities.

13. The milling solution of claim 12 which contains about 20–150 g/l of hydrogen peroxide.

14. The milling solution of claim 12 wherein the metal product consists essentially of a titanium alloy having at least one of the following: an alpha phase, beta phase and gamma phase.

15. The milling solution of claim 14 wherein the alloy is selected from the group consisting of: Ti-6Al-4V, Ti-6Al-6V-2Sn, Ti-10V-2Fe-3Al and commercially pure titanium.

16. The milling solution of claim 12 wherein the bath is heated to about 21°–57° C. (70°–135° F.) for milling purposes.

17. The solution of claim 12 wherein titanium is removed from the product surface at a rate of about 0.15 mils/side/minute or higher.

18. The solution of claim 12 which produces a post-milling hydrogen content of about 150 ppm or less.

19. A nitrate-free solution suitable for milling a titanium product at one or more temperatures in the range of about 16°–71° C. (60°–160° F.), said solution consisting essentially of: about 20–100 g/l of hydrofluoric acid; a hydrogen inhibitor selected from the group consisting of: about 55–650 g/l of sodium chlorate, about 180–650 g/l of ammonium peroxysulfate and at least about 10 g/l of hydrogen peroxide; and a balance of water and impurities.

20. The solution of claim 19 wherein milling occurs at about 21°–57° C. (70°–135° F.).

21. The solution of claim 19 wherein the titanium product is made from an alloy selected from the group consisting of: Ti-6Al-4V, Ti-6Al-6V-2Sn, Ti-10V-2Fe-3Al and commercially pure titanium.

22. The solution of claim 19 wherein the titanium product is a Ti-6Al-4V forging.

23. The solution of claim 19 which produces a post-milling hydrogen content of about 150 ppm or less.

24. A method for chemically milling a metal workpiece comprising:

(a) providing a substantially nitrate-free aqueous solution consisting essentially of about 20–100 g/l of hydrofluoric acid and at least one hydrogen inhibitor selected from the group consisting of: about 55–650 g/l of sodium chlorate, about 180–650 g/l of ammonium peroxysulfate, and at least about 10 g/l of hydrogen peroxide;

(b) maintaining the solution at one or more temperatures in the range of about 16°–71° C. (60°–160° F.); and (c) immersing the workpiece in the solution to mill the workpiece surfaces in contact with the solution.

25. The method of claim 24 wherein the solution contains about 20–150 g/l of hydrogen peroxide.

26. The method of claim 24 which further comprises one or more of the following steps before immersing step (c):

(i) cleaning the workpiece; and (ii) masking areas of the workpiece.

27. The method of claim 24 which further comprises one or more of the following steps after workpiece immersion:

(i) stirring or agitating the solution while the workpiece remains immersed therein; and (ii) rinsing the workpiece after it is removed from the solution.

28. The method of claim 24 wherein the workpiece is made from a titanium alloy.

29. The method of claim 28 wherein the workpiece is a forging made from a titanium alloy selected from the group consisting of: Ti-6Al-4V, Ti-6Al-6V-2Sn, Ti-10V-2Fe-3Al and commercially pure titanium.

* * * * *